United States Patent [19]

Lincke

[11] Patent Number: 4,488,579

[45] Date of Patent: Dec. 18, 1984

[54] GRIPPER PROJECTILE

[75] Inventor: Paul Lincke, Zell, Switzerland

[73] Assignee: Sulzer Brothers, Ltd., Winterthur, Switzerland

[21] Appl. No.: 482,208

[22] Filed: Apr. 5, 1983

[30] Foreign Application Priority Data

Apr. 7, 1982 [CH] Switzerland ..... 2144/82

[51] Int. Cl.[3] ..... D03J 5/06

[52] U.S. Cl. ..... 139/196.2; 139/439

[58] Field of Search ..... 139/196.2, 196.3, 437, 139/438, 439

[56] References Cited

U.S. PATENT DOCUMENTS 3,412,763 11/1968 Wueger ..... 139/196.2

FOREIGN PATENT DOCUMENTS 1098801 1/1968 United Kingdom ..... 139/196.2

*Primary Examiner*—Henry S. Jaudon

*Attorney, Agent, or Firm*—Kenyon & Kenyon

[57] ABSTRACT

The gripper projectile has a spring-biased clamping member which is biased against a guide nozzle into which a weft yarn is blown in by a weft yarn supplying nozzle. The clamping member is provided with an aperture which enables a projectile opener to be introduced to retract the clamping member from the nozzle to permit the nozzle to directly communicate with discharge orifices in the side walls of the projectile. With the clamping member in the retracted position, a weft yarn end can be delivered while the yarn entraining air is immediately discharged along with any fluff that may be carried by the air stream.

6 Claims, 4 Drawing Figures

GRIPPER PROJECTILE

This invention relates to a gripper projectile and, particularly, to a gripper projectile for a weaving machine.

As is known, gripper projectiles have sometimes been constructed to cooperate with a pneumatic weft supplying nozzle. In such cases, the projectiles have been provided with a weft yarn clamp, for example in the form of an axially movable springbiased clamping member within a hollow body as well as with a guide nozzle at a forward end of the body against which the clamping member may abut to clamp a delivered yarn. In such cases, the body of the projectile has been provided with discharge orifices to allow the discharge of air which enters into the projectile from the insertion nozzle.

It has also been known from Swiss Pat. No. 435,141 to have the insertion nozzle introduced into the projectile so as to disengage the clamping member from the guide nozzle and, thus, open the clamp for the reception of a weft yarn. However, it has been found that the air entering into the projectile from the insertion nozzle creates a turbulence in the hollow interior of the projectile because of the position of the discharge orifices. This turbulence, in turn, reacts back into the guide nozzle and makes the introduction of the weft yarn end difficult. In addition, there is a risk of entrained fluff becoming deposited in the projectile and causing subsequent malfunctioning of the yarn clamp.

It is object of the invention to provide a gripper projectile for receiving an air-borne weft yarn end which can be used with conventional projectile opening mechanisms.

It is another object of the invention to be able to slightly modify existing gripper projectiles to cooperate with a weft supplying nozzle in a manner to avoid turbulence.

It is another object of the invention to obviate unwanted turbulence and the deposition of fluff within a gripper projectile used with a weft yarn insertion nozzle.

Briefly, the invention provides a gripper projectile which is comprised of a body having a hollow interior, a guide nozzle disposed in the interior of the body, and a clamping member disposed in the body for movement between a yarn clamping position in abutment with the nozzle and a retracted position spaced from the nozzle.

The body is provided with at least a pair of oppositely disposed discharge orifices which communicate with the interior while the nozzle has a rear end defining a passage in register with the discharge orifices.

When in the clamping position, the clamping member clamps a yarn between the nozzle and the clamping member. When in the retracted position, the clamping member permits registry between the nozzle passage and the discharge orifices so that a flow of air delivered into the nozzle may pass out of the orifices.

In order to move the clamping member, a spring is provided in the body in order to bias the clamping member into the clamping position, i.e. against the nozzle. In addition, the clamping member is provided with an elongated aperture which is aligned with a pair of opposed apertures in the body in order to permit passage of a projectile opener therethrough for movement of the clamping member to the retracted position.

The gripper projectile can be opened using a projectile opener of a conventional opening mechanism. Thus, when opened, the air which entrains a delivered weft yarn is able to pass directly out of the projectile through the discharge openings in the projectile body without creating any turbulence. In this respect, the clamping member together with the nozzle serves to define the flow path for the exiting air.

The gripper projectile is constructed such that the clamping member is able to center itself in the guide nozzle during a closing movement. In this way, a weft yarn can be reliably clamped. Further, since the closing distance is very short, the distance travelled by the projectile opener during an opening movement can also be short.

These and other objects and advantages of the invention will become more apparent in the following detailed description taken in conjunction with the accompanying drawings wherein.

Figure 2:
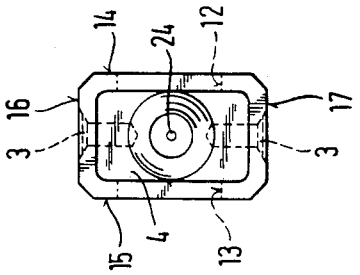
FIG. 2 illustrates an end view of the projectile of FIG. 1.
Figure 1:
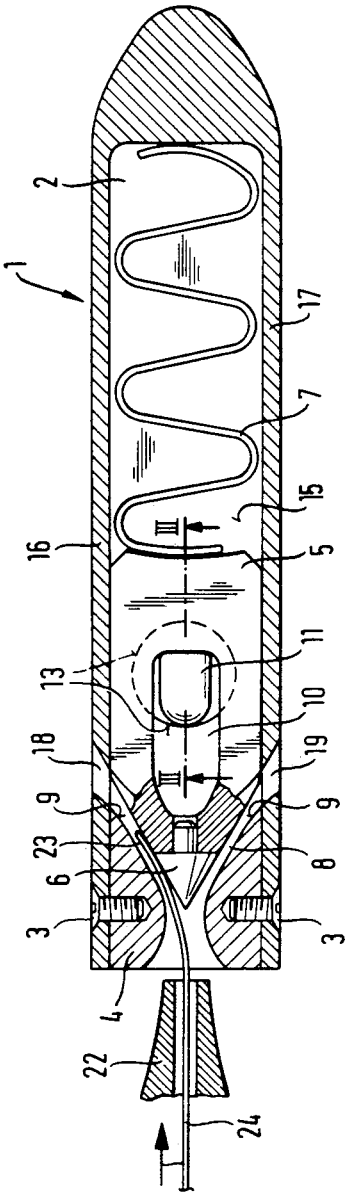
FIG. 1 illustrates a longitudinal cross-sectional view through a gripper projectile constructed in accordance with the invention.

Referring to FIG. 1, the gripper projectile has a body 1 which defines a hollow interior 2. In addition, the gripper projectile has a guide nozzle 4 which is disposed in the interior 2 of the body 1 for receiving a weft yarn. As indicated, the guide nozzle 4 is secured to the end of the projectile body 1 via screws 3. In addition, a clamping member 5 is disposed in the body 1 for movement between a yarn clamping position in abutment with the nozzle 4 and a retracted position (as shown) spaced from the nozzle 4.

Figure 3:
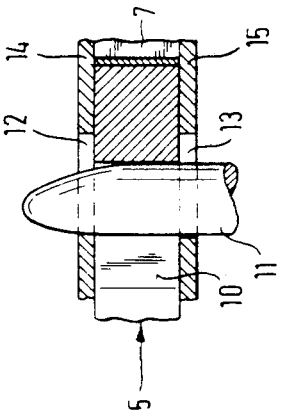
FIG. 3 illustrates a partial cross-sectional view taken on line III—III of FIG. 1.
Figure 4:
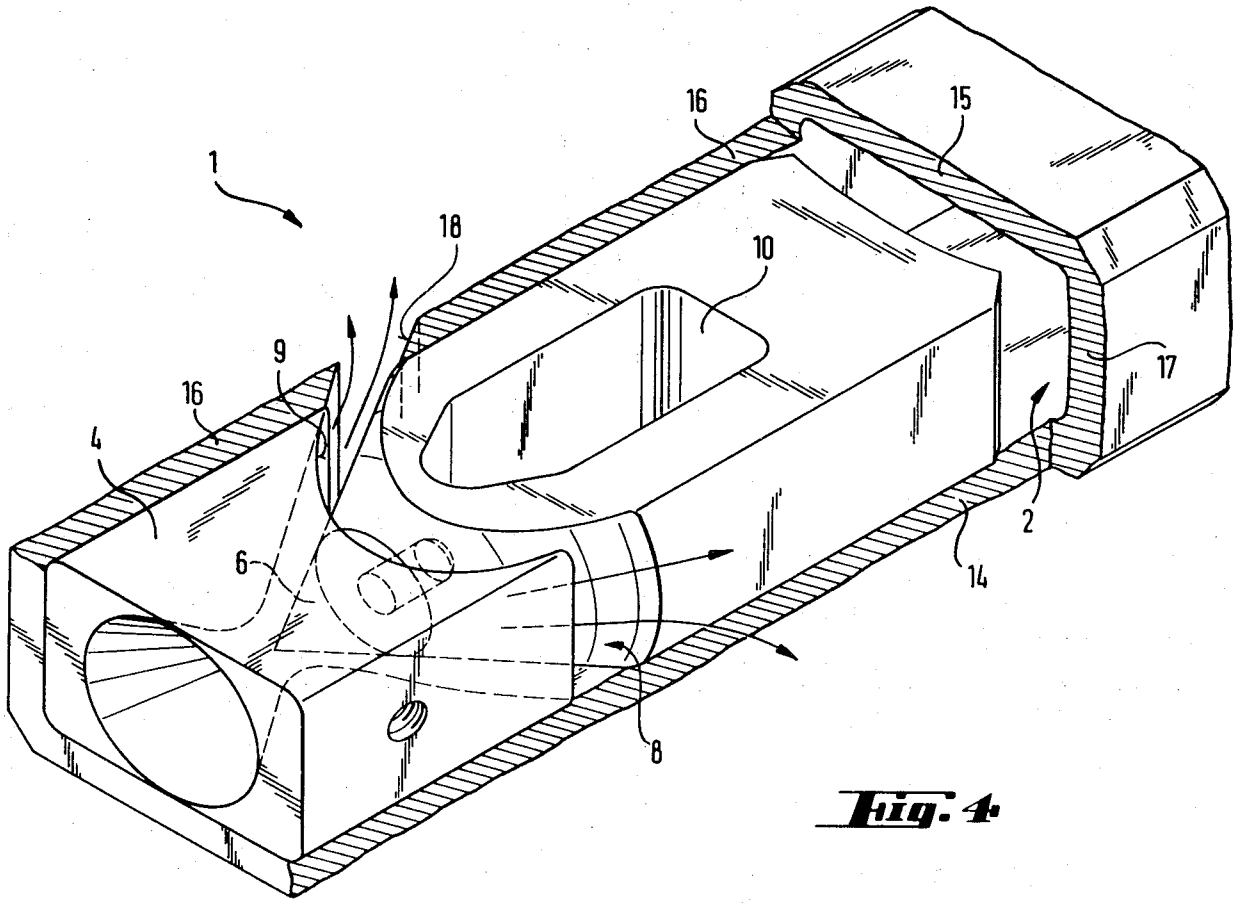
FIG. 4 illustrates a partial fragmentary view of one end of the gripper projectile of FIG. 1.

The clamping member 5 is axially moveable within the body 1 and is biased by a spring 7 into a passage 8 defined in a rear end of the nozzle 4. In addition, the clamping member 5 has a cone 6 at the forward end for abutting an inside wall 9 of the passage 8 of the nozzle 4. As indicated in FIGS. 1 and 4, the clamping member 5 also has an elongated aperture 10 which is aligned with a pair of opposed apertures 12, 13 in opposite walls 14, 15 of the projectile body 1. These apertures 10, 12, 13 are sized so as to receive a projectile opener (see FIG. 3) of known construction.

As shown in FIG. 1, the side walls 16, 17 of the projectile body 1 are provided with oppositely disposed discharge orifices 18, 19 which register with i.e. are in alignment with the passage 8 of the nozzle 4.

The gripper projectile is adapted for use with a weft yarn supplying nozzle or device 22 which serves to blow a forward end 23 of a weft yarn 24 into the projectile body 1.

When in the clamping position, the clamping member 5 clamps the end 23 of the weft yarn 24 against the wall 9 of the passage 8 in the nozzle 4. When in the retracted position, the clamping member 5 is spaced from the nozzle 4 so as to permit registry between the passage 8 and the discharge orifices 18, 19. This permits any air which flows into the nozzle 4 to be immediately discharged via the discharge orifices 18, 19.

In use, immediately before picking, the opener 11 disengages the clamping member 5 from the wall 9 of the nozzle passage 8. Immediately thereafter, the yarn insertion nozzle 22 blows the end 23 of a weft yarn 24 into the guide nozzle 4 until the yarn end 23 engages the passage 8. The air which is thus injected flows directly through the passage 8 and orifices 18, 19 to the surrounding atmosphere. Thus, air turbulence cannot be induced and any fluff which is carried along in the air flow leaves the projectile immediately.

Just before the picking of the projectile which is about to occur, the opener 11 is withdrawn from the clamping member 5 and projectile body 1. This permits the spring 7 to bias the clamping member 5 into the clamping position within the passage 8. This serves to clamp the weft yarn end 23. The projectile is then put into flight and the weft yarn is picked into a weaving machine (not shown).

The invention thus provides a gripper projectile of relatively simple construction which can reliably clamp a pneumatically delivered weft yarn end therein. Further, the gripper projectile can be used with conventional projectile opening mechanisms without having to make unnecessary alterations therein.

The features of the invention may also be incorporated into existing gripper projectiles with relatively few modifications of the existing projectiles.

What is claimed is:

1. A gripper projectile for a weaving machine comprising a body having a hollow interior and at least a pair of discharge orifices communicating with said interior;

a guide nozzle disposed in said interior of said body for receiving an air injected weft yarn and having a passage at one end; and an axially movable spring-biased clamping member disposed in said body for abutting said nozzle within said passage to clamp a weft yarn therebetween, said member having an elongated aperture for receiving a projectile opener to disengage said member from said nozzle while placing said passage in alignment with said discharge orifices for immediate discharge of injected air therethrough.

2. A gripper projectile comprising a body having a hollow interior and at least a pair of oppositely disposed discharge orifices communicating with said interior;

a nozzle disposed in said body at one end of said interior, said nozzle having a rear end defining a passage in alignment with said discharge orifices; and a clamping member disposed in said body for movement between a yarn clamping position in abutment with said nozzle and a retracted position spaced from said nozzle whereby in said clamping position, said clamping member clamps a yarn between said nozzle and said member and in said retracted position, said clamping member permits registry between said nozzle passage and said discharge orifices for the immediate flow of air delivered into said nozzle out of said orifices.

3. A gripper projectile as set forth in claim 2 which further comprises a spring in said body biasing said clamping member into said clamping position.

4. A gripper projectile as set forth in claim 3 wherein said clamping member has an elongated aperture aligned with a pair of opposed apertures in said body for passage of a projectile opener therethrough to move said clamping member to said retracted position.

5. A gripper projectile as set forth in claim 3 wherein said clamping member has a cone at one end for abutting said nozzle in said clamping position.

6. A gripper projectile as set forth in claim 2 wherein said clamping member has a cone at one end for abutting said nozzle in said clamping position.

* * * * *

UNITED STATES PATENT AND TRADEMARK OFFICE

CERTIFICATE OF CORRECTION

PATENT NO. : 4,488,579

DATED : December 18, 1984

INVENTOR(S) : Paul Lincke

It is certified that error appears in the above-identified patent and that said Letters Patent is hereby corrected as shown below:

Column 1, line 31 after "is" insert --an--

Signed and Sealed this

*Third* Day of *September 1985*

[SEAL]

*Attest:*

DONALD J. QUIGG

*Attesting Officer* *Acting Commissioner of Patents and Trademarks - Designate*